United States Patent [19]

Hayes

[11] 4,082,057

[45] Apr. 4, 1978

[54] APPARATUS FOR SPRAYING INTERIOR SURFACE OF VESSELS

[75] Inventor: Tom F. Hayes, La Porte, Tex.

[73] Assignee: Tenneco Chemicals, Inc., Saddle Brook, N.J.

[21] Appl. No.: 569,880

[22] Filed: Apr. 21, 1975

[51] Int. Cl.[2] ..... B05C 7/02

[52] U.S. Cl. ..... 118/9; 118/305; 118/323; 134/168 R; 134/171; 239/265

[58] Field of Search ..... 118/306, 317, 323, 9, 118/7, 305; 134/99, 167 R, 168 R, 171; 239/227, 265

[56] References Cited

U.S. PATENT DOCUMENTS

| | | | |
|---|---|---|---|
| 2,878,058 | 3/1959 | Gauthier et al. | 118/323 X |
| 3,444,869 | 5/1969 | Guignon et al. | 239/227 X |
| 3,791,583 | 2/1974 | Nunlist et al. | 134/167 R X |

*Primary Examiner*—John P. McIntosh
*Attorney, Agent, or Firm*—McLean, Boustead & Sayre

[57] ABSTRACT

Methods and apparatus are disclosed for directing a fluid spray against the interior surfaces of a reaction vessel, without the need for operating personnel to enter the vessel, employing orbiting nozzles connected by a conduit to an annular piston assembly all of which are contained in a cylinder housing mounted externally on the vessel. A hydraulic or pneumatic force is alternately applied to one of the piston surfaces, the rate and direction of movement of the piston, and hence the spray nozzles being controlled by the discharge of fluid from the cylinder housing on the opposite side of the piston. In one embodiment the hydraulic pressure used to drive the piston is provided by the same pressurized fluid which is used in the spraying operation.

8 Claims, 5 Drawing Figures

APPARATUS FOR SPRAYING INTERIOR SURFACE OF VESSELS

FIELD OF THE INVENTION

This invention relates to apparatus for spraying a liquid onto the interior walls and ceiling of chemical process reactor vessels, such spraying being for the purposes of cleaning or coating the vessel. More specifically, the invention relates to methods and apparatus which accomplish such spraying while the vessel remains closed, thereby eliminating exposure of operating personnel to the potentially hazardous atmosphere of the vessel's interior. This invention is especially adapted for cleaning and coating of reactors used for the industrial production of polyvinyl chloride, or PVC, where personnel exposure to the vinyl chloride monomer, or VCM, must be minimized.

BACKGROUND OF THE INVENTION

The cleaning and spray coating of the interior surfaces of industrial chemical-reaction vessels has long been a problem. In the practice of many commercial chemical processes reaction vessels become coated with undesirable reaction products which must be periodically removed. To avoid subjecting maintenance personnel to the unpleasant and often hazardous task of entering the vessel and mechanically washing or scraping the sidewalls and interior surfaces, various types of mechanical devices have been utilized to accomplish the cleaning. These devices include rotating spray heads which are introduced into the vessel to discharge a pressurized stream of water or other solvent to dislodge the accumulated material. After the interior surface has been cleaned, it is then often spray-coated with a release agent to facilitate the next cleaning operation. These prior art spraying devices have generally required extensive and complicated mechanical linkages between nozzles and the electric motors which gradually insert the spray nozzle into the vessel. In addition to the electrical and mechanical hook-ups, flexible conduits were required for transmitting the cleaning liquid or solvent from the storage container to the apparatus. This apparatus, in addition to being complicated and cumbersome was subject to frequent breakdowns and required considerable maintenance to keep it in proper operating condition. In addition to the problems inherent with this type of complex mechanical spraying apparatus, such apparatus had to be either removed from the tank to protect it from the effects of weather if the reaction vessels were located outside, or the cleaning apparatus had to be provided with an adequate structural protective housing. Even if the apparatus were mounted on a reaction vessel located indoors special care had to be exercised to prevent damage from overhead cranes or other material-handling equipment operating in the area.

It is therefore an object of the present invention to provide apparatus for spray cleaning and coating the interior surfaces of reaction vessels which have the following characteristics and advantages:

(a) eliminates the need for personnel to enter the interior of the vessel;
(b) are permanently mounted on the exterior surface of the vessel;
(c) are inserted into the interior of the vessel during the spraying operation and withdrawn prior to the next use of the vessel;

(d) are readily isolated from the atmosphere of the reaction vessel when withdrawn;
(e) are protected from the natural environment and elements, and from damage as a result of inadvertent or careless actions of operating personnel;
(f) eliminates the need for complicated mechanical linkages and external sources of direct mechanical power and the use of flexible hosing and conduits;
(g) utilizes hydraulic or pneumatic pressure to move the spraying means into and out of the reaction vessel;
(h) utilizes the same pressurized fluid that is sprayed to move the spray means into and out of the vessel;
(i) reduces substantially the time cycle for cleaning and/or spraying the vessel; and
(j) reduces maintenance time and expense.

Further objects and advantages will become apparent from the detailed description of the invention which follows.

DETAILED DESCRIPTION OF THE INVENTION

The invention is more completely described with reference to the following figures in which like numerals are used to identify like elements in the construction.

Figures 1, 4:
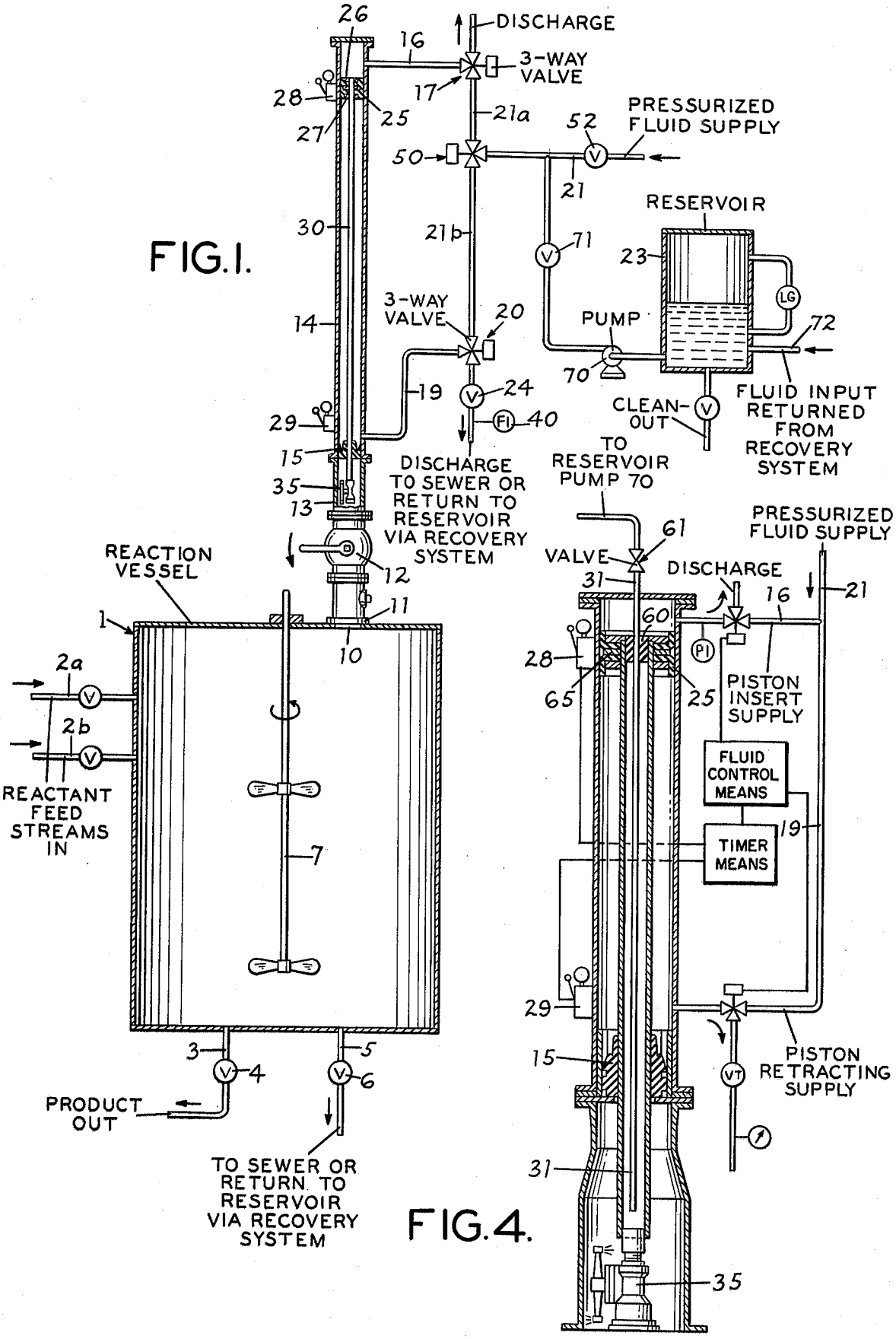
FIG. 1 is a schematic view of the apparatus of my invention.
FIG. 4 is a schematic representation of a further embodiment of my invention.

With reference to the general schematic diagram of FIG. 1 there is shown reaction vessel 1, having several valved conduits 2*a* and 2*b* for charging reactants into the vessel, and conduit 3 and valve means 4 for removing the reaction product from the vessel. In addition, the vessel is equipped with drain conduit 5 and valve 6 for disposal of a cleaning solvent or fluid and contaminants via sewer, or to waste treatment means. The vessel is also shown with conventional mixing means 7 which is usually a centrally located shaft with blade, or other type agitators affixed thereto.

The reaction vessel 1 is provided with at least one access hole 10 located in the top of the vessel. Access hole 10 must be of a size and configuration which is adequate to permit passage of the spraying apparatus through it. Depending on the size, number and configuration of the mixing means 7 it may be necessary to provide the vessel with more than one spraying apparatus. When a coating such as a release agent is to be sprayed after cleaning of the vessel, similar but smaller apparatus can be installed over appropriately sized access holes.

Valve mounting flange 11, having an inside diameter corresponding to access hole 10 is permanently affixed to the top of the vessel. It is to be understood that valve mounting flange 11 will be of a configuration determined by the slope or curvature, if any, of the top of the reaction vessel so that the central axis of the flange is vertical. It is desirable to have the entire retractable spraying assembly mounted in a vertical position to eliminate strain on the rigid conduits, seals, welds and points of connection of the apparatus. It is to be appreciated that this is the preferred embodiment of the invention, but that with suitable modification, the retractable spraying mechanism could be mounted for insertion into the reaction vessel 1 at practically any angle between 90° and the horizontal.

Valve 12 is assembled by conventional means on the upper surface of flange 11. In the preferred embodiment, valve 12 is a ball valve, which in the open position provides a passage of the same diameter as the inside diameter of the flange 11 and the conduits attached thereto. It is necessary that valve 12, while in the open position, provide a direct-line passage for the nozzle assembly. It is therefore possible to use a gate or other type of valve in which the closure means is completely withdrawn from the valve passage when the valve is in the open position.

Valve 12 is equipped with flange or other suitable mounting means for assembly thereto of nozzle housing conduit 13. The inside diameter of nozzle housing conduit 13 must be sufficient to accommodate the rotating nozzle assembly in the retracted position. Nozzle housing conduit 13 is equipped with suitable flanges for attachment of rigid steel cylinder housing 14. Cylinder 14 is equipped with fixed lower cylinder seal 15 proximate its lower open end and adjacent nozzle housing conduit 13.

Mounted internally and slidably within cylinder 14 is annular piston assembly 25 having upper face 26 and lower face 27. Affixed to piston 25 and passing therethrough, and in communication with the inside of cylinder 14 above the upper piston face 26, is fluid delivery tube 30. Fluid tube 30 is mounted coaxially within cylinder 14, and with nozzle housing conduit 13, valve 12 and flange 11 over access hole 10. Thus, as piston 25 moves downwardly tube 30 is permitted direct and unhindered entry into the reaction vessel through open valve 12.

On the end of tube 30 opposite piston 25 is mounted spray nozzle means 35. Any of a number of conventional spray nozzles well known in the art can be employed. In a preferred embodiment of the invention an orbiting type spray nozzle is employed. Particularly suitable for this use is the type of spray nozzle which rotates about the central longitudinal axis of tube 30 and also rotates about an axis perpendicular to said longitudinal axis. By appropriate selection and orientation of the nozzle orifices a substantially spherical spray pattern can be obtained. An example of this type of spray nozzle is the device manufactured by Spraying Systems, Inc. under the trademark Orbi-Jet Rotary Impact Scrubber. The biaxial rotation of this type of spray nozzle device is produced by the passage of the pressurized spraying fluid through the body of the device and out the spray nozzles. Another type of rotating spray nozzle device is the Butterworth model manufactured by Graham Chemical Co. of Ventura, Calif. The specific spray nozzle design and construction does not form a part of this invention, and the devices referred to above are intended only to be exemplary of the type which can be employed.

Cylinder housing 14 is fitted with communicating upper cylinder conduit 16 and associated three-way valve control means 17. This upper cylinder conduit 16 provides for admission and discharge of the pressurized coating fluid or cleaning composition which is to be employed for moving the piston assembly 25 and scrubbing or coating the inside of the reaction vessel. The entry of conduit 16 must be above the uppermost point of travel of piston assembly 25 within cylinder housing 14.

In addition, cylinder housing 14 is equipped with communicating lower cylinder conduit 19 and associated three-way valve control means 20. The lower conduit 19 likewise provides for the admission or discharge of fluid and must be located between the lower cylinder seal 15 and the lowest point of travel of piston 25 on the downstroke. Upper and lower cylinder conduits 16 and 18, respectively, are connected through suitable piping, described below, to a source of pressurized fluid. For many applications the pressurized fluid utilized can be simply water, with or without chemical additives.

Cylinder housing 14 is further equipped with an upper limit indicator and switch 28 at a position corresponding to the uppermost point of travel of piston 25; and lower limit indicator and switch 29 at a position corresponding to the lowermost point of travel of piston assembly 25. It will be appreciated that the height of cylinder housing 14, the length of fluid delivery tube 30, and the travel of piston assembly 25 are predetermined by the depth or height of the reaction vessel and the extent to which nozzle means 35 must be inserted into said vessel to completely accomplish the satisfactory spraying or cleaning of the vessel walls.

Figure 2:
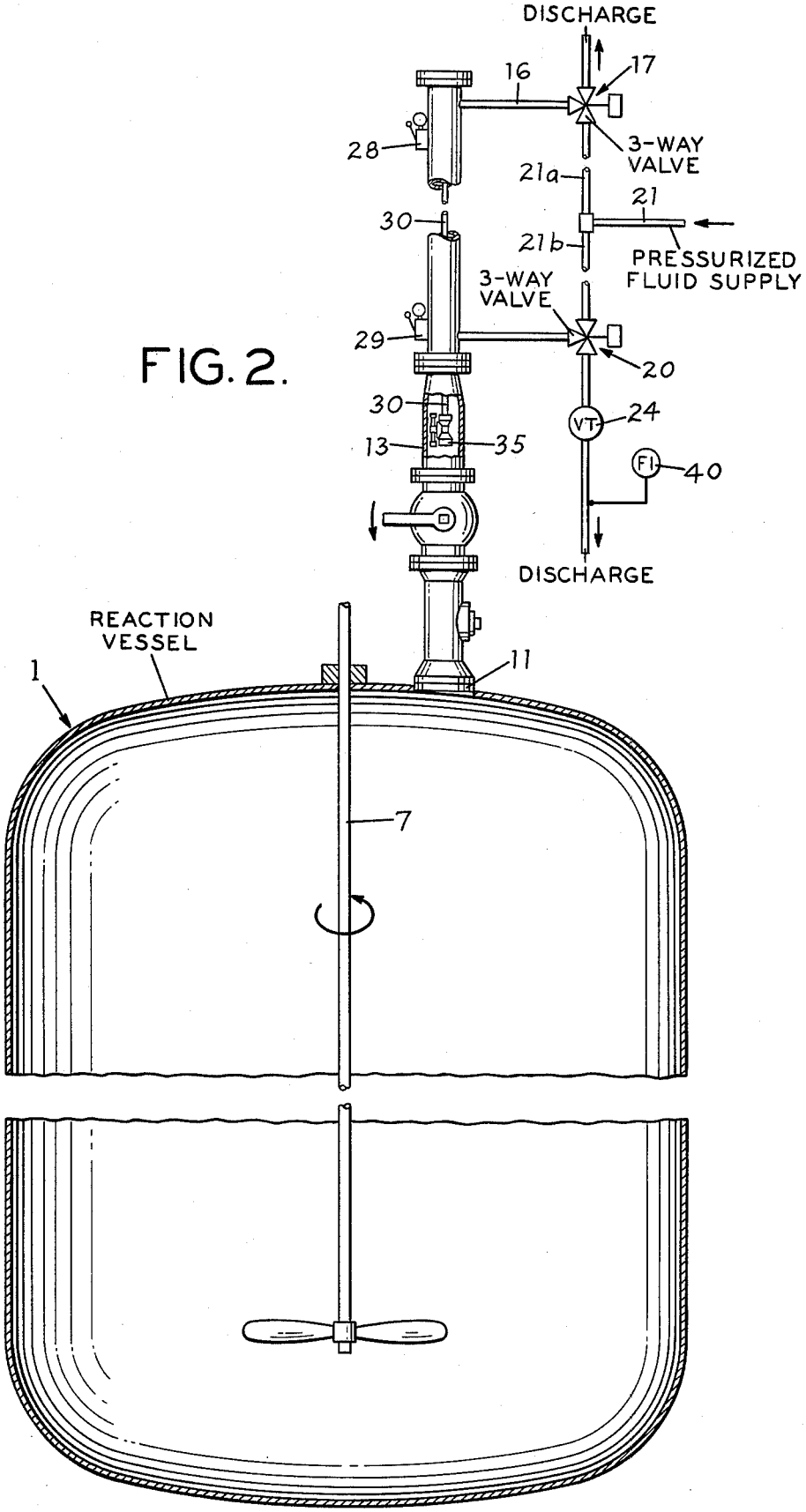
FIG. 2 is a front elevational view, partly cut-away, showing one embodiment of the apparatus of my invention with the spraying apparatus in the retracted position.
Figure 3:
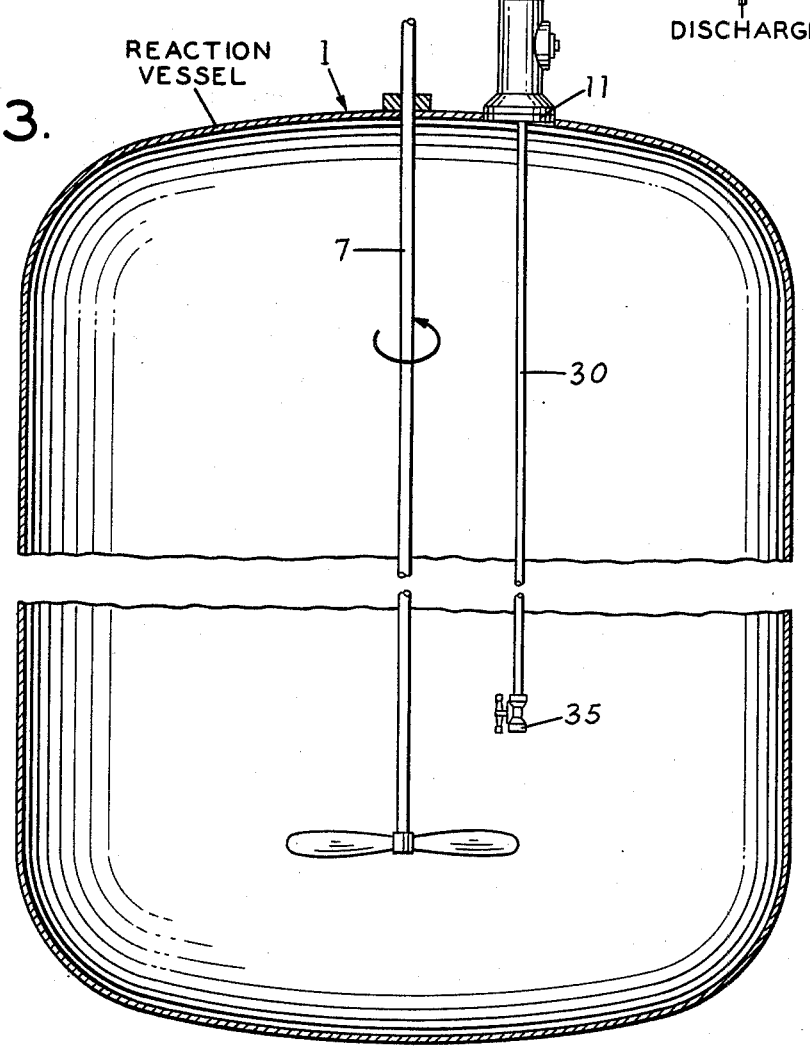
FIG. 3 is a front elevational view, also partly cut away, similar to that of FIG. 2 with the spraying apparatus inserted into the vessel.

With reference to the specific embodiment of the invention shown in FIGS. 2 and 3, conduit 21 carrying pressurized fluid from an external supply branches into conduits **21*a* and 21*b*, which are connected to three-way valves 17 and 20, respectively. These valves can be of the solenoid type to permit the remote activation and control of the system. Also connected to three-way valve 20 by suitable conduits is throttle valve 24, having its discharge side connected to the sewer or other recovery means. The remaining port of three-way valve 17** is likewise provided as a discharge to the sewer or recovery system.

With specific reference to the embodiment shown in FIG. 2, wherein the spraying apparatus is shown in the withdrawn position, and the reaction product has been discharged from vessel 1, the following steps comprise a complete spraying or cleaning cycle:

(a) ball valve 12 is moved to the open position;

(b) valve 17 is moved to the open position which permits pressurized fluid from conduit **21*a* to flow through conduit 16 and into cylinder housing 14 above piston assembly 25**;

(c) approximately simultaneously with step (b), three-way valve 20 is moved from the closed position, to the position which permits the controlled discharge of fluid from cylinder housing 14, below piston assembly 25, through regulator/throttle valve 24;

(d) pressurized fluid also flows down discharge conduit 30 to activate, and be discharged through the nozzles of spray means 35;

(e) the rate of discharge of fluid through throttle valve 24 is controlled to determine the rate of descent of piston assembly 25, and thereby spray means 35, under the combined effects of the forces of gravity and the pressurized fluid above piston assembly 25;

(f) as piston assembly 25 approaches lower limit indicator 29 a visible and/or audible alarm is activated and valve 17 is moved to stop the flow of pressurized fluid through conduit 16 and to connect conduit 16 to the discharge conduit at valve 17;

(g) simultaneously with step (f), three-way valve 20 is positioned to stop the flow of fluid from cylinder housing 14 via throttle valve 24, and to permit the flow of pressurized fluid from conduit 21*b*, through conduit 19 and into cylinder housing 14 below piston assembly 25, which arrangement causes the upward movement of the piston, and thereby the withdrawal of spray means 35 from the interior of the vessel;

(h) the upward travel of piston 25 causes the fluid above surface 26 to bleed off through either the discharge side of valve 17 or the spray means 35, or both, and as piston assembly 25 approaches upper limit indicator 28 a visible or audible alarm is activated; and (i) valves 17 and 20 are moved to the closed position, as is ball valve 12, thereby isolating the apparatus and fluid sources from the reaction vessel and completing the spraying cycle.

During operation of the apparatus as described above, lower cylinder seal 15 prevents the pressurized fluid from escaping around fluid delivery tube 30 and into the reaction vessel. An indicated in the step-wise sequence of operations, when the pressurized fluid is admitted into the top of the cylinder above piston 25, some of this pressurized fluid will feed down through fluid delivery tube 30 and be emitted by nozzle means 35 which will be activated as the fluid pressure builds up above the piston in the upper portion of the cylinder. The volumetric flow rate of pressurized fluid delivered to the upper cylinder conduit must be sufficient to drive the spray nozzle means and also provide a reserve or back pressure on the upper face 26 of the piston. If the system is allowed to stabilize at this point the fluid will be delivered to and activate the rotary spray nozzle means 35, but the fluid below the piston being essentially incompressible, the piston will not underto any downward movement. When throttle valve 24 is opened the fluid below the piston will be discharged through lower cylinder conduit 19, and the rate of descent of the piston assembly delivery tube and nozzles can be controlled by means of the throttle valve and properly calibrated flow-indicator gauge 40. As the piston assembly 25 moves downwardly, the now activated nozzle means moves out of nozzle housing conduit 13 and through the bore of open valve 12 into the interior of reactor vessel 1. The desired rate of travel of the nozzle will in part be determined by the ability of the spray nozzles to clean the internal walls of the reactor vessel and as such must be determined on the basis of the successful removal of the contaminants or reactants.

The reaction vessel can be drained of cleaning fluid and dislodged contaminants by opening vessel drain valve 6 and discharging this material into the sewer or suitable recovery or treatment means. After the reaction vessel has been completely drained valve 22 is closed and the reactor is again ready for charging with fresh reactants. Once valve 12 has been closed the nozzle spray means 35 are securely protected from contamination or encrustation by the reactants admitted to the vessel.

It will also be appreciated that the above-described apparatus which utilizes a single fluid for hydraulically operating the apparatus to cause the up and down travel of the piston has the advantage that any leakage of fluid around the piston itself or around the lower cylinder seal will not serve as a contaminant for the cleaning solution or vice versa. The entire system operates on the basis of pressure differentials acting on the elements of the apparatus and avoids the use of complicated mechanical or electromechanical linkages.

Moreover, once the apparatus has been withdrawn from the vessel and valve 12 has been closed the possibility of inadvertently discharging the cleaning fluid into the reaction vessel which has been charged with reactants is eliminated.

A further embodiment of the invention is shown with reference to FIG. 4 wherein a separate conduit for delivery of high pressure fluid is connected to fluid delivery tube 30. This further embodiment can advantageously be utilized where the pressure that must be supplied to the spray means 35 is substantially above the pressure which can be maintained between the piston seals and cylinder sidewalls and the lower cylinder seal 15. In this embodiment a relatively lower pressure fluid is admitted and discharged, respectively, through conduits 16 and 19 as described above, and the high pressure fluid is introduced through valve 61 into delivery tube 31 which passes through an opening in cylinder top 20 and is coaxial with fluid delivery tube 30. Conduit 31 is welded or otherwise secured in a fixed position with respect to cylinder housing 14 and top 20. Annular seal 60 is inserted between the coaxial tubes 30 and 31 to insure that the pressurized fluid entering through tube 31 will be discharged only through spray nozzle means 35. The high pressured fluid delivery tube 31 extends well into conduit 30 and terminates near the point of attachment of the nozzle means 35. The length of high pressure delivery tube 31 must be such that it cannot be completely withdrawn from conduit 30 and seal 60 during the downstream of piston assembly 25.

In the operation of the embodiment of FIG. 4, the same general sequence of steps as described above in connection with FIGS. 2 and 3 are followed, with the additional step that valve 61 is opened as the nozzle means are inserted into the vessel. Piston assembly 25, conduit 30 and spray means 35 move downwardly into the vessel, while annular seal 60 prevents escape of the spray fluid into the cylinder housing above piston surface 26.

In a further embodiment of the invention, which will be understood with reference to FIG. 4, a pressurized gas, or pneumatic force, provides the means for driving the piston assembly and related components. It will be appreciated that while the operation of the spraying apparatus using a pneumatic force is substantially the same as described above, the specific valves, conduits and fittings used will have to be those designed for handling pressurized gases. The use of a non-toxic gas provides the advantage that the discharge can be into the atmosphere.

The use of a separate conduit 31 for feeding the fluid to be sprayed has a particular advantage where the sprayed fluid must be delivered at a high pressure, or where it is of a specialized formulation that is expensive or otherwise impractical to maintain in sufficient quantities to serve as the hydraulic fluid for moving the piston assembly, or where it is desired to use a pneumatic force to move the piston. In certain applications the use of a pneumatic force provides the means of avoiding potential contamination of the fluid introduced through conduit 31 for spraying by leakage of the piston driving fluid through seals 15 and 60. Such contamination by small amounts of water is particularly detrimental to various classes of liquids which are sprayed on the clean interior walls of PVC reactor vessels and serve as release agents to aid in the later removal of encrusted reactants. By using an inert or otherwise non-reactive compressed gas, such as nitrogen to provide the pneumatic force leakage through seals 15 and 60 will not adversely affect the sprayed fluid. The ability to discharge the gas into the atmosphere eliminates the need for a certain portion of the conduits, valves and related fittings if the piston driving fluid is a liquid.

In order to facilitate necessary maintenance or repairs or removal of the apparatus from the reaction vessel nozzle housing conduit 13 can be advantageously equipped with a suitable quick disconnect coupling as the means of attachment to valve 12.

In addition, lower cylinder seal 15 may be fabricated as a separate article for insertion between the base of cylinder 14 and the nozzle housing conduit 13. Lower cylinder seal 15 may advantageously employ a packing gland of the V-type teflon packing or the lock-in strip rubber of appropriate dimensions.

Figure 5:
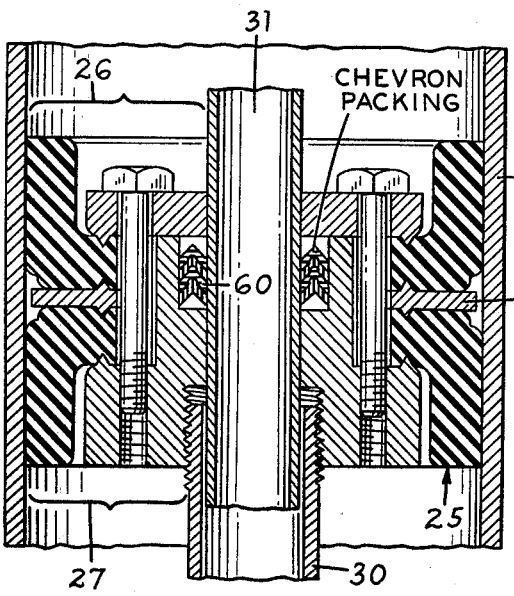
FIG. 5 is a front elevational view, also partly cut away, of a typical piston assembly used in one embodiment of the invention.
Figure 5:
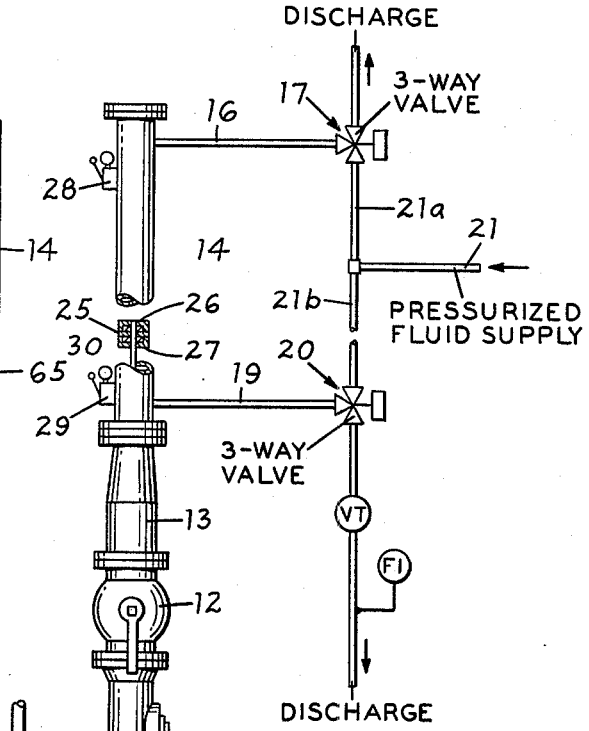

With reference to FIG. 5, it will be appreciated that the piston assembly 25 can be fabricated from conventional components, including for example, Lubri-cup, Darcova or molded rubber and synthetic rubber cups to provide the seal between the piston assembly and the cylinder housing walls. The piston assembly also includes an annular ferrous element 65 to activate the magnetic limit switches 28 and 29 when the assembly is of stainless steel. It is to be understood that when the apparatus is constructed in accordance with the embodiment of FIGS. 1, 2 and 3, that the typical piston assembly shown in FIG. 5 will be modified to the extent that tube 31 is not present, and that the end of conduit 30 will be flush with, or below the upper piston surface 26, and the only seals required will be those at the periphery of the piston 25 in sliding contact with inside walls of cylinder housing 14.

The principal metallic parts of the assembly including especially the cylinder housing 14, piston assembly 25 and fluid delivery tubes 30 and 31 are preferably fabricated from stainless steel to prevent rusting, pitting and corrosion of the interior surfaces of the apparatus which come into contact with the cleaning solvent or solution. In addition, the outside surface of fluid delivery tube 30, and in the embodiment of FIG. 4, tube 31, are polished to provide a smoother sliding surface and insure better sealing; likewise the interior surface of the cylinder housing 14 is honed to improve the performance of the seals comprising the piston assembly 25.

With further reference to FIG. 1 and 4 there is shown a further modification to the preferred embodiments previously described which includes a reservoir 23 and optional recycling system. With specific reference to FIG. 1, fluid from the reservoir is provided at the desired pressure from pump 70 through appropriate conduits and reservoir delivery valve 71 to conduit 21, valve 52 having been previously closed to prevent entry of other pressurized fluids into the system. The system will be made to function as described above with the additional advantage that the fluid can be recovered from the bottom of the reaction vessel 1 through conduit 5 and valve 6 and returned to the reservoir via conduit 72 and appropriate intermediate conduit means. With further specific reference to FIG. 4, fluid can be pumped at high pressure from reservoir 23 through suitable conduit to valve 61 and therethrough into fluid input tube 31 to cause the apparatus to operate as previously described. It will be understood, in connection with the description provided above with reference to FIG. 1, a comparable recovery system can be readily employed.

It will be appreciated by those familiar with this art that the entire system can be automatically controlled by conventional electronic apparatus and electro-mechanical valve operating and control means. For example, upper and lower limits switch indicators 28 and 29 can be of the magnetic type which are wired through appropriate circuitry to electro-mechanical valve opening devices attached to the fluid conduits 16 and 19. Thus, when piston assembly 25 approaches upper limit indicator switch 28 an electronic signal is generated that activates means to close lower cylinder conduit valve 20 and shut off the flow of pressurized fluid into the cylinder. When it is desired to activate the spraying apparatus an electronic signal is transmitted to electro-mechanical means for opening valve 12 and at the same time opening throttle valve 24 to a predetermined setting and activating electro-mechanical means on upper cylinder conduit valve 17 to admit a pressurized fluid into the upper cylinder chamber. When the piston reaches the lower limit indicator switch 29 its proximity activates an electrical signal which is transmitted through conventional circuitry to activate means which close valve 17 and thereafter open valve 20 and close throttle valve 24 and thereby cause piston 25 to be raised and retract the nozzle means. Means can also be provided for opening and closing ball valve 12 on signal. Since all of the valves and controls can readily be programmed to function in accordance with a predetermined timed cycle it is possible to completely automate the cleaning and/or spraying operation.

As previously mentioned the availability of quantities of water may make it feasible to permit this fluid to be disposed of by flushing it down a sewer. However, in the event that a chemical cleaning fluid or solvent or other chemical additives must be provided with the spray fluid it may be more practicable to recover this fluid in a reservoir. In addition to storing the fluid for reuse the reservoir could also serve as a settling tank for removal of heavy solid contaminants or reactants removed from the reactor sidewalls which can be periodically removed from the reservoir. In addition the reservoir could itself serve as a storage and pressure vessel for the high pressure fluid to be delivered in accordance with the further embodiment of the invention described with reference to FIG. 4.

It has been found that spray cleaning using orbiting rotating spray nozzles can be accomplished using water supplied at a pressure of 125 psi. In other applications water delivered at pressures of up to about 5000 psi to the orbiting rotating spray nozzle of a Butterworth type device is useful in removing heavy polymer buildup and scale in a PVC reactor. Proper selection of spray nozzle means permits liquid coatings, such as release coatings, to be applied at operating pressures as low as 40 to 60 psi.

It will be appreciated that while the above description has been specifically directed to the spray cleaning and coating of stationary chemical process reaction vessels, that the methods and apparatus disclosed are readily adapted for use in any instance where it is desired to clean the interior surfaces of relatively large shipping and/or storage containers. For instance, the invention in any of its embodiments has obvious advantages and utility in cleaning the holds and interior compartments of ships and particularly tank ships which have to be freed of crude oil residues to accept dry or other milk cargoes. The invention could be retained at dockside for temporary installation and use on ships which have discharged their cargo. Under such circumstances flexible conduits, hoses and the like would be attached to conduits 21 and 31 to permit the rapid installation and removal of the apparatus from suitable fittings on the deck of the ship.

What I claim is:

1. An apparatus for directing a liquid spray against the interior walls of a vessel from rotating nozzle means which comprises:

(a) a cylinder housing mounted externally on the vessel;

(b) a piston assembly slidably mounted within the cylinder housing;

(c) a fluid conduit one end of which is affixed to said piston assembly;

(d) annular lower cylinder housing seal means fixedly mounted within the cylinder housing surrounding the fluid conduit;

(e) a fluid delivery tube affixed to, and passing through the end of the cylinder housing opposite the vessel, and passing coaxially through the piston assembly and into the fluid conduit, and terminating at a point below the lowermost position of travel of the piston assembly; and (f) annular seal means affixed to the piston assembly for slidably receiving the coaxial fluid delivery tube, which elements (a) through (f) cooperate to provide pressure tight expandable chambers above and below the piston assembly; and (g) upper cylinder conduit means with affiliated means for alternatively admitting and discharging a pressurized fluid into the cylinder housing above the piston assembly;

(h) lower cylinder conduit means with affiliated means for alternatively controllably discharging and admitting a pressurized fluid into the cylinder housing below the piston assembly;

(i) a source of pressurized fluid and means for alternatively delivering it to the upper and lower cylinder conduits to produce a movement of the piston in the direction of and away from the vessel responsive to the flow of the pressurized fluid;

(j) rotating nozzle means mounted on the end of the fluid conduit opposite the piston assembly;

(k) a source of pressurized liquid and means for delivering it to the fluid delivery tube and to thereby activate the rotating nozzle means for spraying.

2. The apparatus of claim 1 which further comprises valve means mounted between the vessel and the cylinder housing, which valve means in the open position permit passage of the rotating nozzle means.

3. The apparatus of claim 1 which further comprises signal generating upper and lower limit indicators mounted externally on the cylinder housing which are activated by the proximity of the piston assembly at its predetermined uppermost and lowermost positions of travel.

4. The apparatus of claim 3 which further comprises means responsive to the signals generated by the upper and lower limit indicators for controlling the admission and discharge of fluid from the cylinder housing above and below the piston assembly.

5. The apparatus of claim 4 which further comprises timer means for generating in a predetermined sequence a series of electrical signals, conductor means connected to the timer means for transmitting the signals and control means connected to the conductor means and responsive to the signals for controlling the admission and discharge of fluids from the cylinder housing.

6. The apparatus of claim 1 in which the pressurized fluid admitted into the cylinder housing is a gas.

7. The apparatus of claim 1 in which the fluid admitted to the cylinder housing is not the same fluid which is delivered to the spray nozzle means.

8. The apparatus of claim 1 which further comprises a reservoir and related valve, pumping and conduit means for delivering a pressurized fluid to the upper and lower cylinder housing conduit means and for collecting discharged fluid to be returned to the reservoir.

* * * * *